United States Patent [19]

Snyder et al.

[11] 4,233,795

[45] Nov. 18, 1980

[54] FIELD REPAIR ROOF PANEL FOR A RAILWAY CAR

[75] Inventors: Richard C. Snyder, Michigan City, Ind.; Donald C. Bodinger, Pelham, Ala.

[73] Assignee: Pullman Incorporated, Chicago, Ill.

[21] Appl. No.: 958,084

[22] Filed: Nov. 6, 1978

[51] Int. Cl.[3] ..... E04G 23/02; B61D 17/12

[52] U.S. Cl. ..... 52/514; 52/45; 52/529; 52/741

[58] Field of Search ..... 52/45, 55, 514, 470, 52/468, 537, 529, 464, 741

[56] References Cited

U.S. PATENT DOCUMENTS

| | | | |
|---|---|---|---|
| 84,205 | 11/1868 | Mills | 74/1.5 |
| 434,322 | 8/1890 | Crim et al. | 113/58 |
| 834,467 | 10/1906 | Grafton | 228/137 |
| 1,239,740 | 9/1917 | Tatum | 52/55 |
| 1,821,228 | 9/1931 | Meyers | 297/328 |
| 2,000,299 | 5/1935 | Schlorff | 220/75 |
| 2,511,074 | 6/1950 | Miller | 52/537 X |
| 2,586,318 | 2/1952 | Fields | 52/529 X |
| 2,620,906 | 12/1952 | Ketchum, Jr. | 52/529 X |
| 3,332,711 | 7/1967 | Holly | 52/468 |

FOREIGN PATENT DOCUMENTS

| | | | |
|---|---|---|---|
| 415 | of 1878 | United Kingdom | 52/470 |

*Primary Examiner*—Alfred C. Perham
*Attorney, Agent, or Firm*—Richard J. Myers

[57] ABSTRACT

A replacement roof panel for repairing damaged railway car roofs in the field. The damaged portion is cut away leaving an opening in the roof. The repair panel is fabricated to the desired width and has reinforcing end portions that form laterally extending stiffening members. The end portions are shaped to provide slots along the lateral edges of the repair panel for receiving the edges of the existing roof sheet. The repair sheet is then welded along its edges to the existing roof sheet and to the side plates of the car.

8 Claims, 6 Drawing Figures

FIG. 1
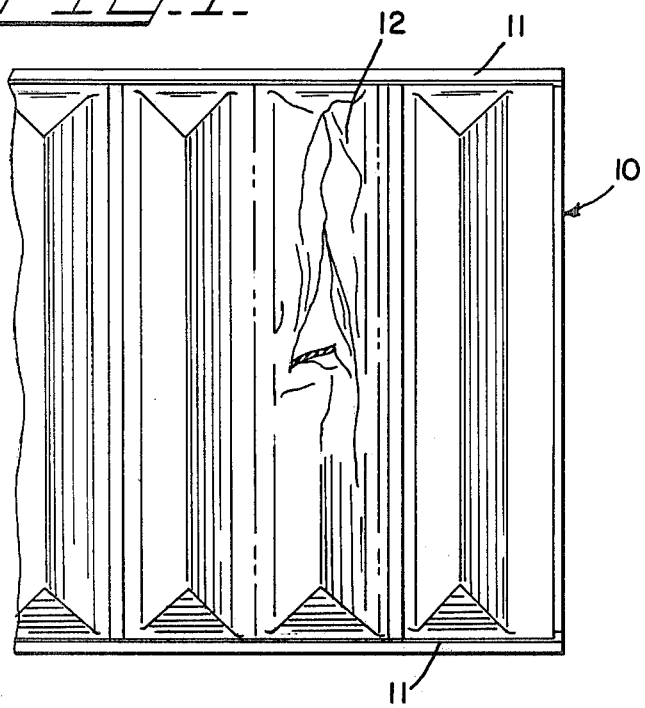
FIG. 2
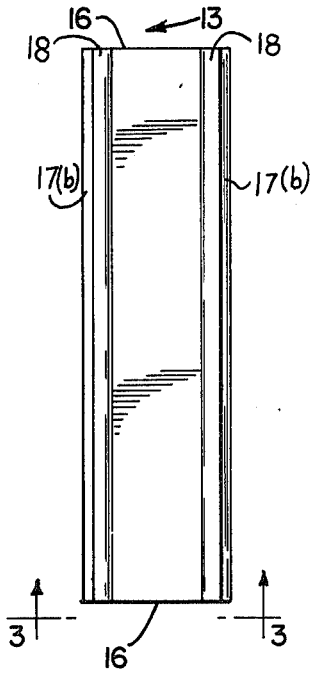
FIG. 3
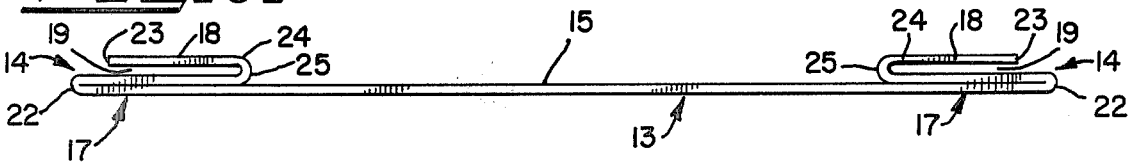
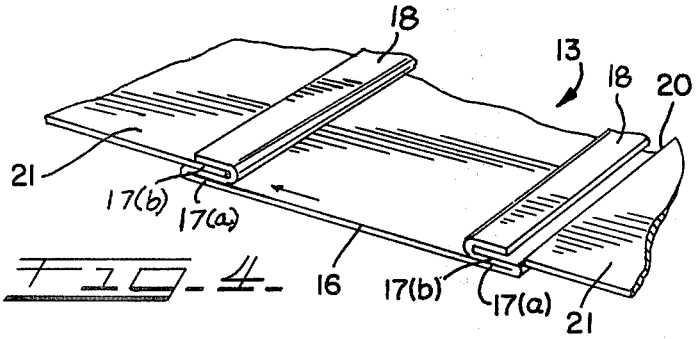
FIG. 4
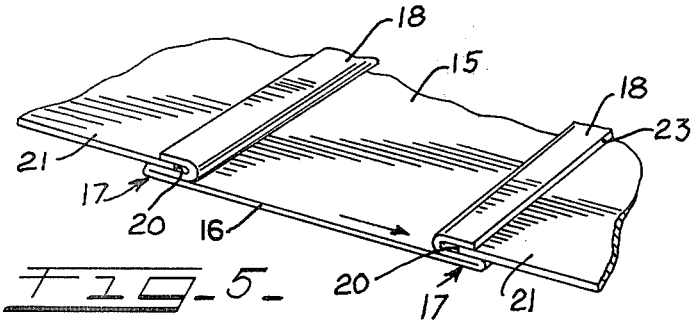
FIG. 5
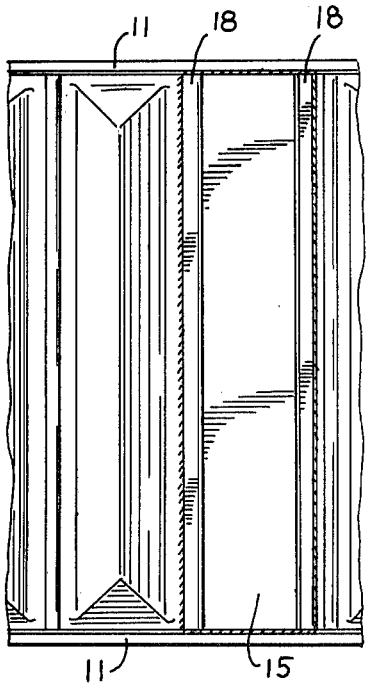
FIG. 6

FIELD REPAIR ROOF PANEL FOR A RAILWAY CAR

BACKGROUND OF THE INVENTION

1. Field of the Invention

The invention relates to railway cars and particularly to a replacement roof panel for use on railway cars.

2. Description of the Prior Art

The prior art includes U.S. Pat. Nos. 1,821,299, issued Sept. 1, 1931; 2,000,299, issued Feb. 8, 1934; 834,467, issued Oct. 30, 1906; 434,322, issued Aug. 12, 1890; 84,205, issued Nov. 17, 1868. The above patents show various arrangements for connecting adjacent sheet metal edge portions.

The present invention is an improvement over the prior art.

SUMMARY OF THE INVENTION

The invention relates to a replacement roof panel for repairing damaged railway box car roofs in the field. The repair panel is formed from a generally rectangular piece of sheet material having lateral end portions shaped to form slots for receiving the margins of the existing roof sheets. The lateral end portions are folded to provide a first or bottom flange of double thickness and a second or top flange. In the installed position the lateral end portions rigidify the roof structure and the double thickness bottom flange acts as a back-up which prevents weld burn-through during welding of the top flange.

When a portion of the roof is damaged it is cut away leaving a generally rectangular opening defined by the longitudinally extending side plates and laterally extending margins of the existing roof sheets. The repair panel is installed by shoving the bottom flange under the edge of the existing roof sheet such that the edge is in the slot. The repair panel is then pulled back and the bottom flange of the other end is positioned under the opposite edge of the existing roof sheet. Thus the edges of the existing roof sheet are positioned in the slots formed by the top and bottom flanges of the repair sheet. Once it is in position, the field repair roof sheet is welded to the existing roof sheet and to the side plates of the car.

BRIEF DESCRIPTION OF THE DRAWINGS

FIG. 1 is a top plan view of a portion of a railway car roof with a damaged section;

FIG. 2 is a plan view of the repair sheet;

FIG. 3 is a side view of the repair sheet taken along line 3—3 of FIG. 2;

FIG. 4 is a fragmentary perspective view of the repair sheet partially installed;

FIG. 5 is a fragmentary perspective view of the roof sheet in the fully installed position;

FIG. 6 is a top plan view of the repair sheet welded in place.

DESCRIPTION OF THE PREFERRED EMBODIMENT

FIG. 1 shows a portion of a railway car roof, generally designated 10, having longitudinally extending side plates 11 and a damaged portion 12 which must be repaired. As best shown in FIG. 3 the repair or replacement panel 13 has a pair of lateral end portions 14 and a middle or central portion 15. The repair panel also has longitudinally extending edges 16.

The end portions 14 each have a first or bottom flange 17 and a second or top flange 18 that form an outwardly opening slot 19 for receiving the edges or margins 20 of the existing roof sheet 21. Each bottom flange 17 has adjacent first and second sections 17(*a*) and 17(*b*), with an outwardly directed nose portion 22. Thus the bottom flange 17 is formed from a double thickness of material which rigidifies the roof structure. The top flanges 18 have an outer free edge 23 and an inner edge 24. The inner edge is connected to the second section 17(*b*) of the bottom flange 17 by an inwardly directed nose portion 25. The central portion 15 of the repair panel 13 can be fabricated to any desired length and width to span the opening which must be covered.

The bottom flange 17 of the lateral end portions 22 is longer than the top flange 18. Thus the top flange 18 terminates at a point over the bottom flange 17 so that in the installed position the bottom flange 17 extends well under the margin 20 of the existing roof sheet 21. This configuration facilitates installation and eliminates the need for a back-up during welding. It also provides a heat sink when the repair panel is welded in place.

The inwardly directed nose 25 forms the terminus for the slot 19. In order that the repair panel 13 can be fitted into place the dimension from the terminus of the slot to the opposite outwardly directed nose 22 must be less than the dimension between the margins 20 of the opening to be covered.

As best shown in FIG. 5, in the installed position the margins 20 of the roof are nested in the slots 19 formed by the top and bottom flanges, 18 and 17 respectively, of the repair panel 13. The top flanges 18 are then welded to the existing roof sheets 21 along their free edges 23 and the longitudinally extending edges 16 of the repair panel are welded to the side plates 11. The double thickness of the bottom flanges 18 rigidifies the structure and the welding provides for a water-tight connection.

INSTALLATION

The damaged section 12 of the roof 10 is cut away having a generally rectangular opening in the roof formed by the margins 20 of the roof sheet and the side plates 11. As best shown in FIGS. 4 and 5, the repair panel 13 is placed in the opening and the bottom flange 17 of the first end portion is shoved under one margin 21 of the existing roof sheet. The roof sheet 21 is then nested between the top 18 and bottom 17 flanges of the first end portion. As shown in FIG. 5 the repair panel 13 is then pulled back positioning the bottom flange 17 of the second end portion 14 under the other margin 21 of the existing roof sheet. Once it is in position the repair sheet is then welded to the existing edges of the roof and to the side plates.

We claim:

1. In a railway car a roof sheet provided with a pair of spaced roof sheet margin portions each defining with the other an opening to be covered by a replacement panel, said replacement panel comprising a sheet of material having an end flange with an outer free edge and an end flange unit generally parallel to and defining with the flange an outwardly opening slot and receiving a respective margin portion of the roof sheet, said slot having an open end at said free edge, said end flange unit having a pair of substantially contiguous generally parallel flange sections that are generally parallel to the flange, one of said flange sections forming a part of said slot and being between the other flange section of the flange, a first nose portion being a curved portion connecting the flange with the one flange section and forming a closed terminus of the slot, said central portion connecting with said other flange sections and said first nose portion overlying said central portion, a second nose portion being a curve portion connecting the one flange section with the other flange section and extending outwardly of the outer edge of the flange in the opposite direction of said first nose portion and forming the outer end part of the end portion, welding means securing each of said outer end portions to said each of said roof margin portions, and each of said outer end part of each said second nose portion extending outwardly of said end outer edge of the flanges providing a welding support and roof margin guide adjacent the outer edge of each flange for attachment of a respective roof sheet margin portion to each flanged outer end portion.

2. The invention in accordance with claim 1, and said flange sections being adjacent to one another to sufficiently provide for a welding back up construction during the welding operation of the panel to the roof margin portions to prevent welf burn-through.

3. The invention in accordance with claim 1, and the maximum distance between the terminus of the slot of one end portion and the outer end of the second nose portion of the other end portion being less than the distance between the roof margin and the replacement panel.

4. The invention in accordance with claim 3, and each slot having a length as defined between the outer edge of the flange and the terminus of the slot, said maximum distance can not be reduced by an amount greater than the length of the slot.

5. The invention in accordance with claim 1, and said welding means welding said outer free edge with the respective roof margin portion over the second nose portion.

6. The invention in accordance with claim 1, and side plates for said railway car, and said replacement panel being adapted to extend between the side plates.

7. A method of repairing a damaged section of a roof sheet comprising:

removing the damage section leaving a quadilateral opening defined by a pair of longitudinal side plates and a pair of transverse roof sheet margin portions, a replacement panel including a pair of flanged outer end portions each having an end flange with an outer free edge and an end flange unit with contiguous flange sections with a closed end nose portion generally parallel to the end flange and extending outwardly thereof defining therewith an outwardly opening slot having a closed end defined by the juncture of the flange with the flange unit.

said closed end nose portion extending outwardly of the outer free edge of the flange and forming the outer end part of the end portion, placing said panel in said opening and moving said panel in a direction toward one of the roof sheet margin portions and guided by said end flange unit so that said margin portion is nested within one of the slots, positioning the panel within said opening so that each of said margin portions are within said slots and each of said end flange units are adjacent to its associated roof sheet margin portion, and laying down a weld bead on each roof margin portion for attachment to a respective end portion, whereby each of said outer end parts providing a welding support and roof margin guide adjacent the outer edge of each flange for attachment of a respective roof sheet margin portion to each flanged outer end portion.

8. The invention in accordance with claims 7, and each of said outer free edges welded to its respective roof sheet margin portion.

* * * * *